US006225579B1

(12) United States Patent
Ritter et al.

(10) Patent No.: US 6,225,579 B1
(45) Date of Patent: May 1, 2001

(54) MULTIPLE SWITCH ASSEMBLY INCLUDING GIMBAL MOUNTED MULTIFUNCTION FOR SELECTIVELY OPERATING MULTIPLE SWITCHES

(75) Inventors: Darin Bradley Ritter; William Hofmann Bose, both of Indianapolis, IN (US)

(73) Assignee: Thomson licensing S.A., Boulogne Cedex (FR)

( * ) Notice: Subject to any disclaimer, the term of this patent is extended or adjusted under 35 U.S.C. 154(b) by 0 days.

(21) Appl. No.: 09/374,024

(22) Filed: Aug. 13, 1999

(51) Int. Cl.[7] ..... H01H 25/04
(52) U.S. Cl. ..... 200/6 A; 200/5 R; 200/18
(58) Field of Search ..... 200/6 A, 5 A, 200/5 R, 338, 4, 6 R, 17 R, 18, 332, 333, 339; 273/148 B; 345/161; 74/471 XY, 471 R; 463/36, 37, 38

(56) References Cited

U.S. PATENT DOCUMENTS

| | | | | |
|---|---|---|---|---|
| 4,124,787 | | 11/1978 | Aamoth et al. . | |
| 4,249,057 | | 2/1981 | Schlegel et al. . | |
| 4,291,201 | | 9/1981 | Johnson et al. . | |
| 4,349,708 | * | 9/1982 | Asher | 200/6 A |
| 4,590,339 | | 5/1986 | Scott-Jackson et al. . | |
| 4,724,286 | | 2/1988 | Cummins . | |
| 4,760,218 | | 7/1988 | Gutman . | |
| 4,786,768 | | 11/1988 | Langewis et al. . | |
| 4,874,224 | | 10/1989 | Gutman et al. . | |
| 4,982,673 | | 1/1991 | Kojima . | |
| 4,992,631 | * | 2/1991 | Gee | 200/5 A |
| 5,034,574 | | 7/1991 | Martovitz . | |
| 5,041,703 | | 8/1991 | Roswold . | |
| 5,065,146 | | 11/1991 | Garrett . | |
| 5,107,085 | | 4/1992 | Roswald . | |
| 5,164,554 | | 11/1992 | Ikunami . | |
| 5,414,231 | * | 5/1995 | Sato et al. | 200/1 R |
| 5,476,261 | | 12/1995 | Hultstrand . | |
| 5,494,445 | | 2/1996 | Sekiguchi et al. . | |
| 5,499,041 | * | 3/1996 | Brandenburg et al. | 345/174 |
| 5,523,531 | | 6/1996 | Ozaki . | |
| 5,579,900 | | 12/1996 | Pryor et al. . | |
| 5,604,483 | | 2/1997 | Giangardella . | |
| 5,675,359 | | 10/1997 | Anderson . | |
| 5,695,346 | | 12/1997 | Sekiguchi et al. . | |
| 5,710,398 | | 1/1998 | Hassler et al. . | |
| 5,738,352 | | 4/1998 | Ohkubo et al. . | |
| 5,823,057 | | 10/1998 | Hsien . | |
| 5,828,364 | * | 10/1998 | Siddiqui | 345/163 |
| 6,096,985 | * | 8/2000 | Ritter et al. | 200/6 A |

* cited by examiner

*Primary Examiner*—J. R. Scott
(74) *Attorney, Agent, or Firm*—J. S. Tripoli; F. A. Wein; R. D. Shedd

(57) ABSTRACT

A gimbal mounted multifunction button has a selector button that can selectively actuate one or more microswitches in response to a biasing force. The multifunction button has a selector button mounted to a gimbal contained in a plate. The selector button has a plurality of protruding actuators that pass through the plate and align with a plurality of microswitches mounted to a printed circuit board. The selector button may be biased to selectively cause one of the of actuators to actuate a corresponding switch, or alternately selectively cause an adjacent pair of actuators to actuate a corresponding pair of adjacent switches.

12 Claims, 5 Drawing Sheets

MULTIPLE SWITCH ASSEMBLY INCLUDING GIMBAL MOUNTED MULTIFUNCTION FOR SELECTIVELY OPERATING MULTIPLE SWITCHES

BACKGROUND OF THE DISCLOSURE

1. Field of Invention

The present invention relates generally to pushbutton selector switches. More specifically, the present invention relates to a gimbal mounted selector switch that selectively actuates a plurality of underlying switches.

2. Description of the Background Art

Assemblies for selectively actuating switch closures in response to a manual movement of a member, such as a multifunction button, have seen increasing utility and are often found in such devices such as computer interfaces, joysticks, automotive mirror controls and the like. One application for multifunction buttons is in telecommunication devices such as televisions and associated peripherals (i.e., control boxes, remotes, video players and the like). These multifunction buttons allow a user to select responses to menu prompts in a quick and efficient manner, using a minimal user interface.

However, multifunction buttons require careful and meticulous design in order to enable an actuator of the multifunction button to close an appropriate contact or switch. Often, the motion enabling device, or hinge, allows some translational motion of the actuator that may allow the actuator to miss the switch, or become "hung-up", i.e., stuck, upon the switch or other surrounding structure. Additionally, some multifunction buttons have a "mushy" or indistinct feel that causes the user to hesitate during selection and rely on a display to confirm that the desired selection was made.

Therefore, there is a need in the art for a multifunction button providing good positional accuracy in relation to the switches associated with the button. Furthermore, such multifunction buttons should have a "positive" tactile feedback such that a user may confidently, and rapidly navigate through a menu screen or otherwise interact with a device or system.

SUMMARY OF INVENTION

The disadvantages associated with the prior art are overcome by the present invention of a gimbal mounted multifunction button. Specifically, the multifunction button of the present invention comprises a selector button having a boss and a plurality of protruding actuators. The selector button is connected to a gimbal disposed in a plate. The gimbal has a plurality of fingers for receiving and retaining the selector button in fixed orientation to the boss. A printed circuit board is disposed at a predetermined distance from the plate. The printed circuit board has a plurality of switches aligned correspondingly with the plurality of protruding actuators. The selector button may be biased to selectively cause one of the of actuators to actuate a corresponding switch, or alternately selectively cause an adjacent pair of actuators to actuate a corresponding pair of adjacent switches.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical element that are common to the figures.

DETAIL DESCRIPTION OF INVENTION

Figure 1:
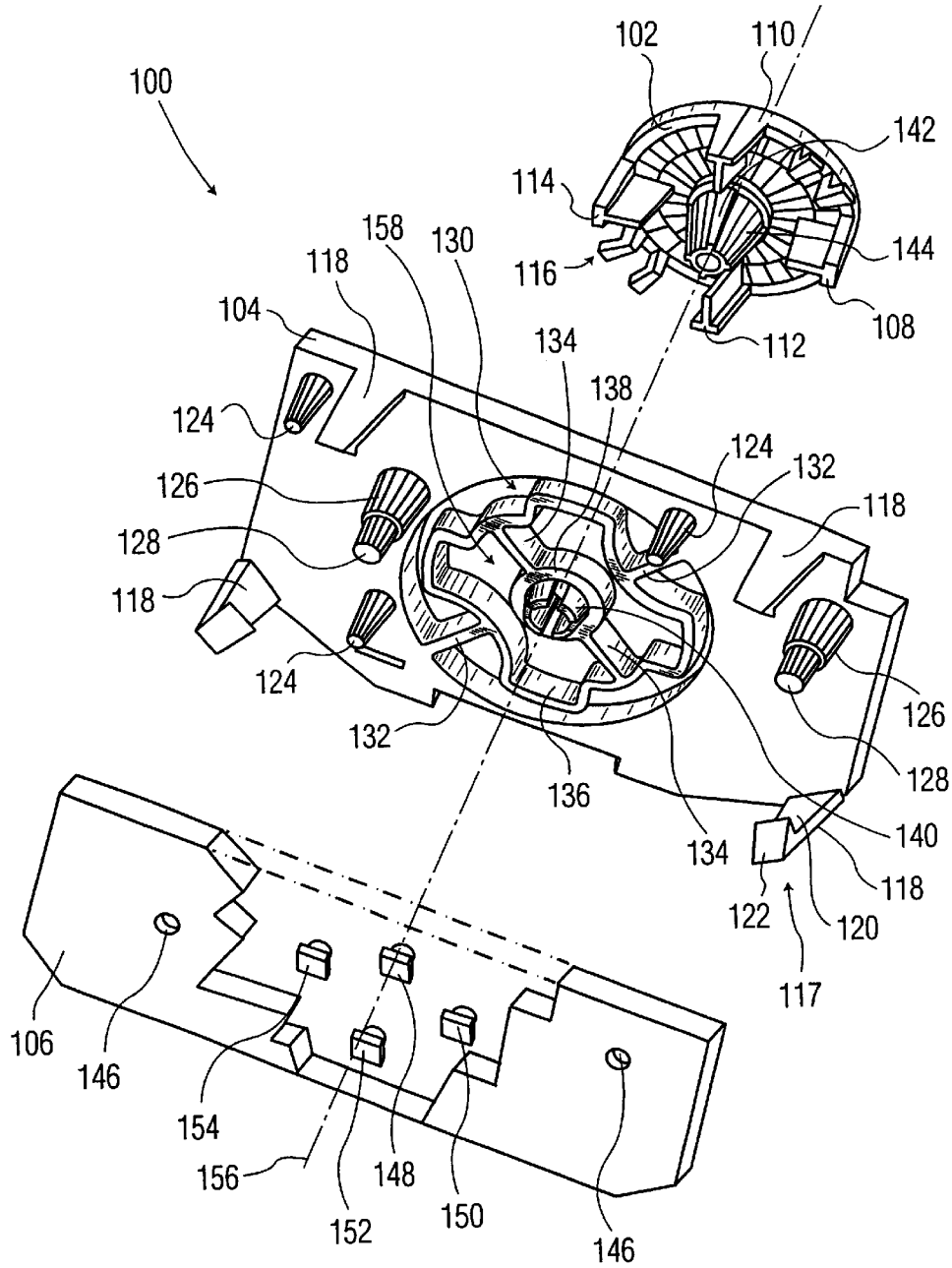
FIG. 1 depicts an exploded isometric view of a multifunction button of the present invention.

Specifically, FIG. 1 depicts a multifunction button assembly 100 having a selector button 102 connected to a gimbal plate 104 that is disposed at a predetermined distance from a printed circuit board 106.

The selector button 102 is preferably fabricated from a moldable plastic (e.g., polycarbonate). The selector button 102 has a boss 142 that protrudes centrally from the selector button 102. The selector button 102 has a first actuator 108, a second actuator 110, a third actuator 112 and a forth actuator 114 protruding from the selector button 102. The actuators 108 through 114 are set equidistantly in a polar array about the boss 142. The selector button 102 additionally has a plurality of retaining tabs 116 set about the selector button's perimeter. The retaining tabs 116 serve to retain the selector button 102 to the multifunction button assembly 100 when the selector button 102 protrudes through a panel of a structure in which the multifunction button is installed (panel and structure not shown).

The gimbal plate 104 is preferably fabricated from a moldable plastic or elastomer. The fabrication material, as well as the cross-sectional areas of certain members discussed below, are selected to preferably provide "positive" tactile feedback during actuation and acceptable service life. It has been found that the gimbal plate 104 molded from polycarbonate produces such a "positive" feel during the actuation of the multifunction button assembly 100, while demonstrating good service life. The gimbal plate 104 has a plurality of first standoffs 124, a plurality of second standoffs 126, and a retention means 117. The first standoffs 124 protrude from the gimbal plate 104 as to maintain the printed circuit board 106 at the predetermined distance from the gimbal plate 104. The second standoffs 126 assist in maintaining the printed circuit board 106 at a predetermined distance from the gimbal plate 104. Each of the second standoffs 126 additionally has a pin 128 that mates with a corresponding hole 146 in the printed circuit board 106, thereby locating the printed circuit board 106 in relation to the gimbal plate 104 upon mating. Of course, the pins 128 and corresponding holes 146 may be readily replaced by other types of locating structures commonly known in the art.

The retention means 117 preferably comprises a plurality of latches 118 (e.g., four latches). Each of the plurality of latches 118 has a flexible member 120 that connects a catch 122 of the latch 118 to the gimbal plate 104. The flexible member 120 allows for the catch 122 to engage (i.e., be snapped over) and retain the printed circuit board 106 against the first and second standoffs 124 and 126, respectively. The retention means 117 may additionally comprise post and screws, heat staking, sonic welding, push connectors, rivets, and the like. One skilled in the art will also appreciate that the gimbal plate 104 need only be held in a predetermined position relative to the printed circuit board 106. As such, other structures comprising a device in which the multifunction button assembly 100 is installed may be utilized to maintain this orientation without necessarily retaining the printed circuit board 106 to the gimbal plate 104.

The gimbal 130 is centrally disposed in the gimbal plate 104. The reader is encouraged to refer simultaneously to FIG. 1 and FIG. 2 for the best understanding of the gimbal 130.

The gimbal 130 comprises a first traverse member 132, a second traverse member 134, an outer ring 136 and an inner ring 138. The outer ring 136 is concentrically aligned with the inner ring 138 along a centerline 156. The first traverse member 132 couples the outer ring 136 to the gimbal plate 104 in two opposing locations. The second traverse member 134 couples the outer ring 136 to the inner ring 138 also in two opposing locations. The first traverse member 132 is preferred to be disposed in an orthogonal orientation with respect to the second traverse member 134. The second traverse member 134, the outer ring 136 and the inner ring 136 are configured to define a plurality of passages 158 between the outer ring 136 and the inner ring 138. The passages 158 respectively accommodate the actuators 108 through 114, allowing the actuators to pass through the gimbal plate 104 when the selector button 102 is connected to the gimbal 130 in the manner described below. The reader will appreciate that utilizing the teachings of the present disclosure, one skilled it the art will be able to devise a number of variations of the gimbal 130 which allow for the actuators (108, 110, 112 and 114) to pass through the gimbal plate 104 while remaining within the scope of the invention.

The first traverse member 132 defines a first axis of rotation 202. The cross-sectional geometry, coupled with the material selection of the gimbal plate 104, allows the first traverse member 132 to flex (i.e., twist) along the first axis 202, allowing the outer ring 136 to rotate as indicated by arrow 204. The second traverse member 134 defines a second axis of rotation 206. The reader should note that as the second traverse member 134, and thus the second axis 206 as well, remains in the plane defined by the outer ring 136. The cross-sectional geometry, coupled with the material selection of the gimbal plate 104, allows the second traverse member 134 to flex (i.e., twist) along the second axis 206. In this manner, the inner ring 138 is allowed to rotate in relation to the outer ring 136, as indicated by arrow 208.

The combined rotation about axis 202 and 206 results in the inner ring 138 acquiring a pivoting motion with respect to the gimbal plate 104 about a pivot point 210 defined by the intersection of the first axis 202, the second axis 206 and the centerline 156. Thus, translational motion of the inner ring 138 with respect to the gimbal plate 104 is substantially prevented.

The inner ring 138 has a plurality of protruding fingers 140 disposed in a polar array about the inside diameter 212. The boss 142 passes through the inside diameter 212 such that the flutes 144 align between the plurality of protruding fingers 140, orientating the selector button 102 with the gimbal plate 104. The boss 142 and protruding fingers 140 are configured as to create an interference fit, thus retaining the selector button 102 in the gimbal 130.

Figure 3A:
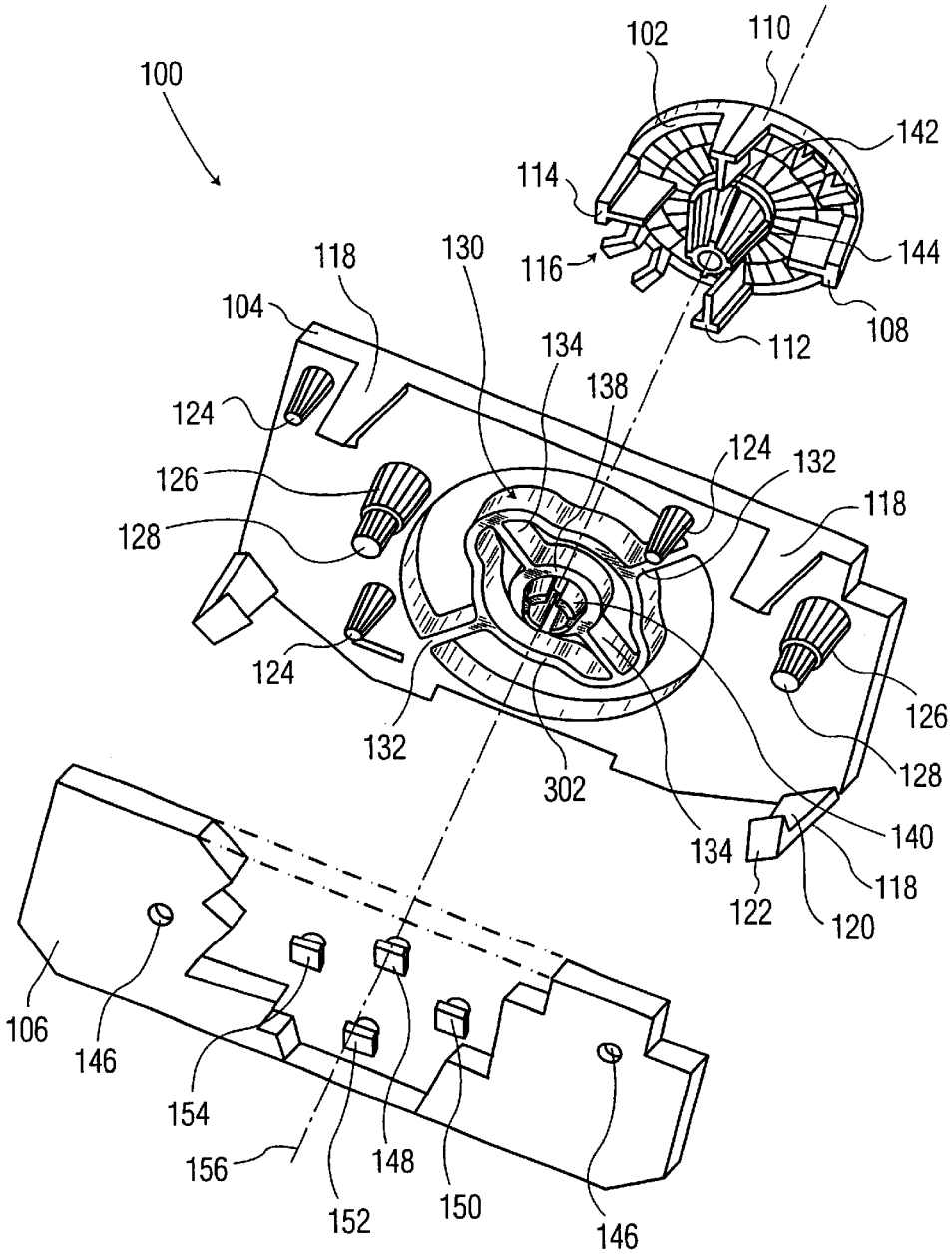
FIG. 3A depicts a detailed view of a second embodiment of a gimbal of the multifunction button of the present invention.

Specifically, the printed circuit board 106 contains a plurality of switches (i.e., microswitches 148 through 154, respectively) that are visible under the cut-away portion of the printed circuit board 106 depicted in FIG. 1, and as mounted to the printed circuit board 106 depicted in FIG. 3A. Although the preferred number of microswitches is four, one skilled in the art may readily modify the selector button 102 and gimbal 130 to accommodate additional (or fewer) microswitches. The microswitches 148 through 154 are arranged in a polar array about the centerline 156. The pins 128 and the locating holes 146 maintain the printed circuit board 106 in an orientation such that the microswitches 148 through 154 remain aligned with the corresponding actuators 108 through 114 of the selector button 102.

Referring now to FIG. 3A, a second embodiment of the gimbal 130 has a first traverse member 132, a second traverse member 134, an outer ring 302 and an inner ring 138. The outer ring 302 is concentrically aligned with the inner ring 138 along a centerline 156. The first traverse member 132 couples the outer ring 302 to the gimbal plate 104 in two opposing locations. The second traverse member 134 couples the outer ring 302 to the inner ring 138 also in two opposing locations. The first traverse member 132 is preferred to be disposed in an orthogonal orientation with respect to the second traverse member 134. The first traverse member 132 and the outer ring 302 are configured to define the passages 158 between the outer ring 302 and the gimbal plate 104. The passages 158 allow the actuators 108 through 114 to pass through the gimbal plate 104 when the selector button 102 is connected to the gimbal 130.

Figure 3B:
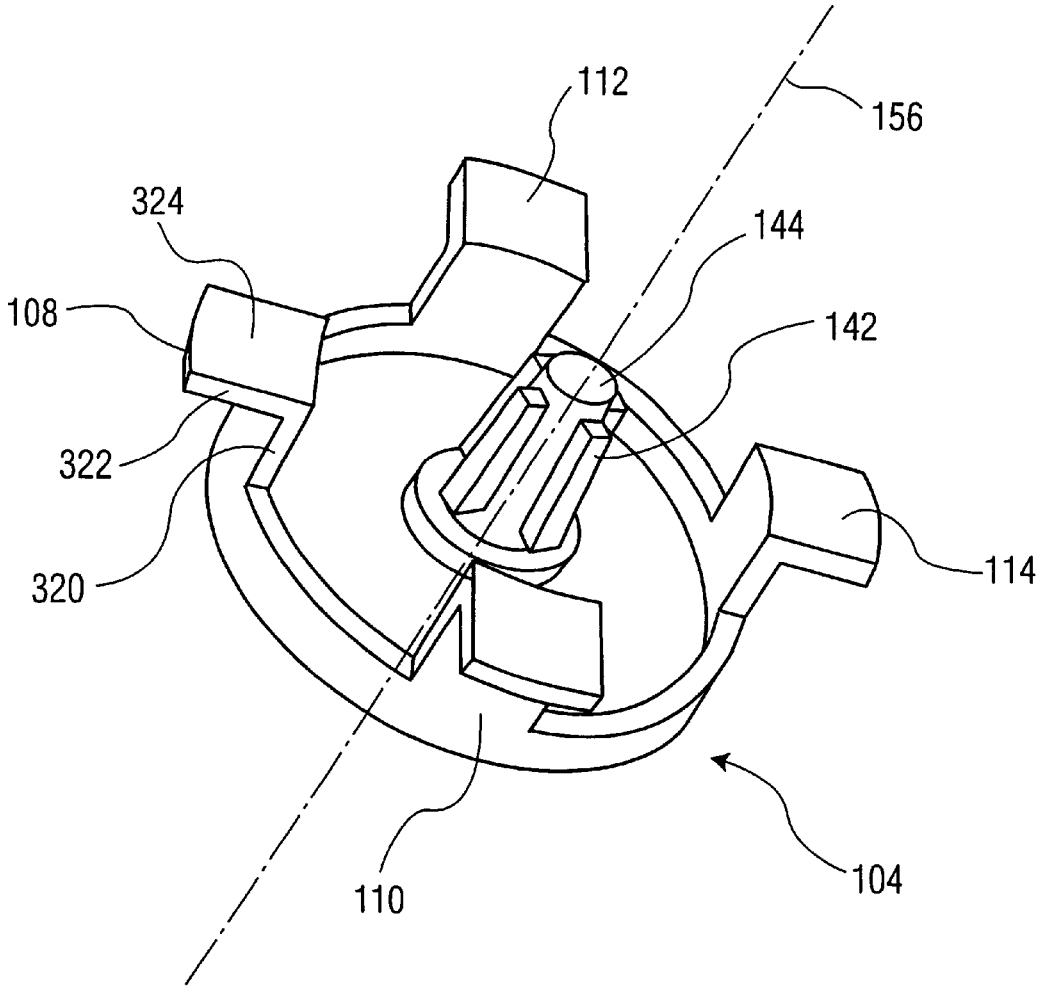
FIG. 3B depicts a detailed view of a second embodiment of a selector button of the present invention.

Referring now to FIG. 3B, a second embodiment of the a selector button 104 comprises a plurality of actuators (108, 110, 112, and 114) that are disposed equidistant in polar array about the perimeter of the selector button 104. Each actuator (108, 110, 112, and 114) has a stanchion 320 that connects an outwardly turned pad 322 to the selector button 104. The pad 322 has a contact surface 324 that is substantially perpendicular to the centerline 156. The contact surface 324 may be selectively biased to contact the underlying microswitch as discussed below.

Figure 4:
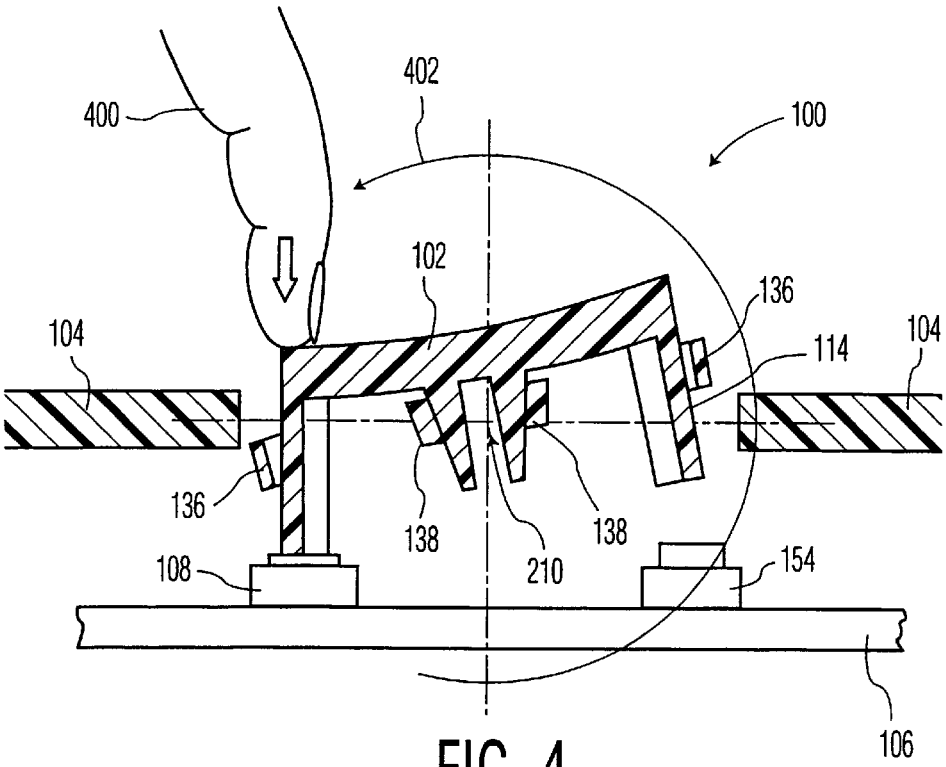
FIG. 4. depicts the gimbal of FIG. 2 responding to a biasing force; and, FIG. 5 depicts the gimbal of FIG. 4 returning to an unbiased position in response to the removal of the force applied in FIG. 4.
Figure 5:
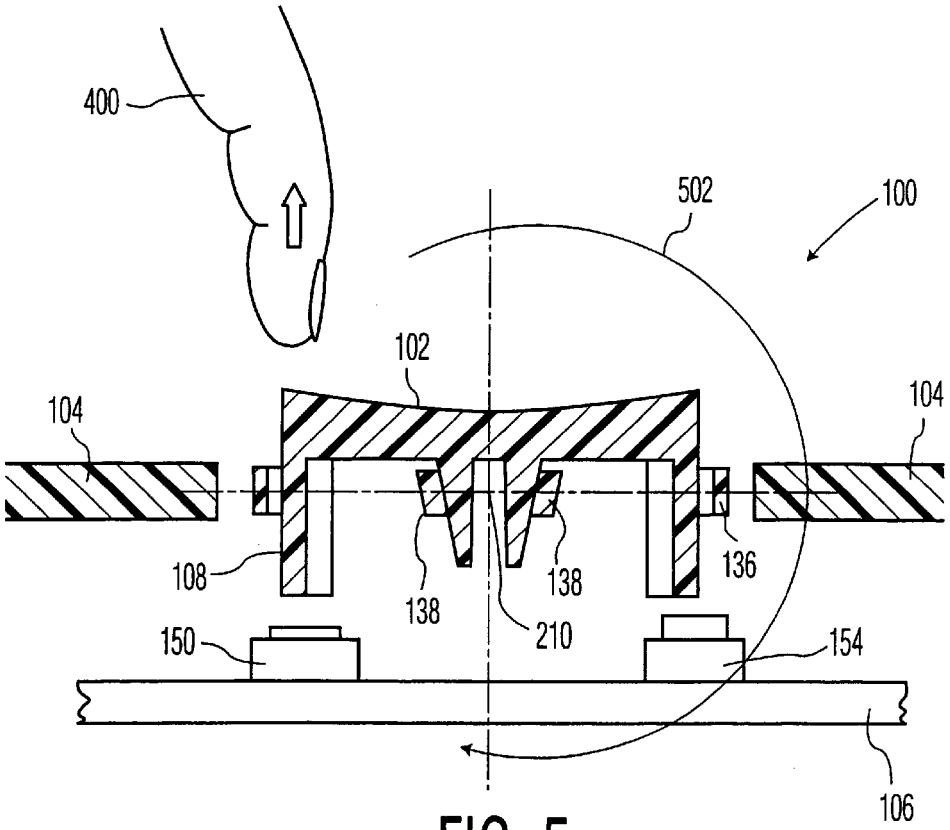

The operation of the multifunction button assembly 100 will now be described while simultaneously referring to FIG. 4 and FIG. 5. Specifically, the multifunction button assembly 100 allows the user to selectively actuate a desired switch on the printed circuit board 106. Such selective actuation finds great utility in a variety of user interactions or user interface applications, such as navigating through a selection of menu choices in order to obtain a desired result. For example, the selector button 102 is manipulated by a biasing force 400, i.e., by depressing a portion of the selector button proximate the desired selection.

Figure 2:
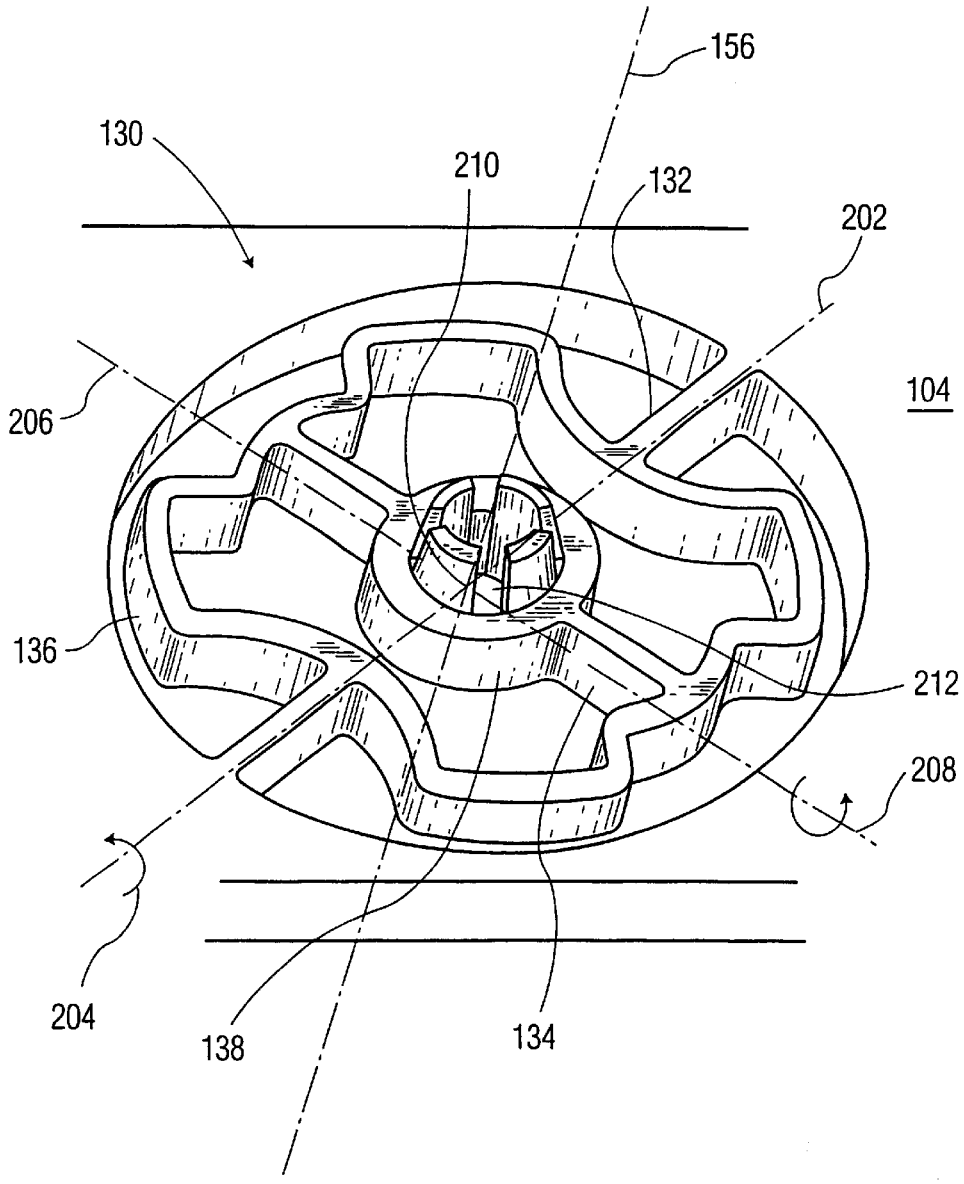
FIG. 2 depicts a detailed view of an embodiment of a gimbal of the multifunction button of the present invention.

The selector button 102 rotates (as depicted by arrow 402) about the pivot point 210 in response to the force 400, thereby causing the actuator 108 to depress (i.e., actuate) the microswitch 150 attached to the printed circuit board 106. Upon removal of the force 400, the resiliency of the traverse members (132 and 134 as seen in FIG. 1 and FIG. 2) causes the selector button 102 to return to an unbiased position as indicted by arrow 502, thereby de-actuating the microswitch 150. The selector button 102 may be biased to actuate any singular microswitch by applying the force 400 to the selector button 102 above the desired microswitch. Alternately, any adjacent pair of microswitches (i.e., 148 and 150, 150 and 152, 152 and 154, and, 154 and 148) may be biased by applying the force 400 to the selector button 102 between the desired microswitches.

As the embodiments that incorporate the teachings of the present invention have been shown and described in detail, those skilled in the art can readily devise many other varied embodiments that still incorporate these teachings without departing from the spirit of the invention.

What is claimed is:

1. Apparatus for actuating a plurality of switches comprising:

a selector button comprising a boss and a plurality of protruding actuators;

a plate comprising a gimbal, said gimbal having a plurality of fingers for receiving said boss;

a printed circuit board, disposed at a predetermined distance from said plate, said printed circuit board comprising a plurality of switches aligned with said plurality of protruding actuators, wherein said selector button may be biased to selectively cause at least one of said plurality of actuators to actuate at least one of said switches;

said plate further comprises a retention means for retaining said printed circuit board at said predetermined distance from said plate, said retention means further comprises a plurality of latches, each of said plurality of latches having a catch which engages said printed circuit board; and wherein said selector button further comprises a plurality of flutes, said flutes aligned between said plurality of protruding fingers and orientating said selector button to said gimbal plate.

2. The apparatus of claim 1 wherein said plate further comprises:

a plurality of standoffs for maintaining said printed circuit board at said predetermined distance from said plate.

3. The apparatus of claim 1 wherein said plate further comprises:

a plurality of protruding pins, each of said plurality of protruding pins mating with a corresponding hole in said printed circuit board.

4. The apparatus of claim 1 wherein said selector button selectively singularly actuates one of said microswitches or selectively actuates an adjacent pair of said microswitches.

5. The apparatus of claim 1 wherein said plate is polycarbonate.

6. Apparatus for actuating a plurality of switches comprising:

a selector button comprising a boss and a plurality of protruding actuators;

a plate comprising a gimbal, said gimbal having a plurality of fingers for receiving said boss;

a printed circuit board, disposed at a predetermined distance from said plate, said printed circuit board comprising a plurality of switches aligned with said plurality of protruding actuators, wherein said selector button may be biased to selectively cause at least one of said plurality of actuators to actuate at least one of said switches;

said gimbal further comprising a first traverse member coupled to said plate, an outer ring coupled to said first traverse member, an inner ring concentrically aligned with said outer ring, said inner ring having a plurality of fingers, said boss of said selector button retained to said gimbal by said fingers, and a second traverse member coupled to said outer ring, said second traverse member being orthogonally disposed to said first traverse member and wherein:

said second traverse member, said outer ring and said inner ring define a plurality of passages in said plate; each of said plurality of passages accommodating a respective actuator.

7. Apparatus for actuating a plurality of switches comprising:

a selector button comprising a boss and a plurality of protruding actuators;

a plate comprising a gimbal, said gimbal having a plurality of fingers for receiving said boss;

a printed circuit board, disposed at a predetermined distance from said plate, said printed circuit board comprising a plurality of switches aligned with said plurality of protruding actuators, wherein said selector button may be biased to selectively cause at least one of said plurality of actuators to actuate at least one of said switches;

said gimbal further comprising a first traverse member coupled to said plate, an outer ring coupled to said first traverse member, an inner ring concentrically aligned with said outer ring, said inner ring having a plurality of fingers, said boss of said selector button retained to said gimbal by said fingers, and a second traverse member coupled to said outer ring, said second traverse member being orthogonally disposed to said first traverse member and wherein:

said first traverse member, said outer ring and said plate define a plurality of passages in said plate; each of said plurality of passages accommodating a respective actuator.

8. Apparatus for actuating a plurality of switches, comprising:

a selector button having a boss and a plurality of protruding actuators, said boss having a plurality of flutes;

a plate having a gimbal, a plurality of standoffs, and a plurality of pins, said gimbal having a plurality of fingers for receiving said boss, said plurality of flutes of said boss aligning with said plurality of fingers and orientating said selector button in relation to said plate; and a printed circuit board, disposed against said plurality of standoffs of said plate, said printed circuit board having a plurality of holes for locating said printed circuit board in relation with said plate, said printed circuit board having a plurality of switches aligned with said plurality of protruding actuators wherein said selector button may be biased to selectively cause at least one of said plurality of protruding actuators to actuate at least one of said plurality of switches.

9. The apparatus of claim 8 wherein said selector button selectively singularly actuates one of said plurality of switches or selectively actuates an adjacent pair of said plurality of switches.

10. The apparatus of claim 9 wherein said gimbal further comprises:

a first traverse member coupled to said plate;

an outer ring coupled to said first traverse member;

an inner ring concentrically aligned with said outer ring, said inner ring having a plurality of fingers, said boss of said selector button retained to said gimbal by said fingers;

a second traverse member coupled to said outer ring and said inner ring; and wherein said first traverse member is orthogonally orientated to said second traverse member.

11. The apparatus of claim 10 wherein said plate is polycarbonate.

12. The apparatus of claim 11 wherein said plurality of switches is four.

* * * * *